US006217677B1

(12) United States Patent
Szuba et al.

(10) Patent No.: US 6,217,677 B1
(45) Date of Patent: Apr. 17, 2001

(54) METHOD FOR ANNEALING STAMPED COMPONENTS

(75) Inventors: Joseph A. Szuba, Dearborn; Dennis Raymond Kolodziej, Redford Township, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/337,008

(22) Filed: Jun. 28, 1999

(51) Int. Cl.[7] ..... C21D 1/04
(52) U.S. Cl. ..... 148/570
(58) Field of Search ..... 148/567, 570

(56) References Cited

U.S. PATENT DOCUMENTS

| | | |
|---|---|---|
| 3,211,364 | 10/1965 | Wentling et al. . |
| 4,496,818 | 1/1985 | Reynolds et al. . |
| 4,864,706 | 9/1989 | Jenkel . |
| 4,868,365 | 9/1989 | Farone et al. . |
| 5,023,419 | 6/1991 | Langstedt . |
| 5,025,124 | 6/1991 | Alfredeen . |
| 5,197,190 | 3/1993 | Coolidge . |
| 5,373,144 | 12/1994 | Thelander . |
| 5,373,809 | 12/1994 | Fox et al. . |
| 5,588,019 | 12/1996 | Ruffini et al. . |
| 5,683,607 | 11/1997 | Gillespie et al. . |
| 5,705,794 | 1/1998 | Gillespie et al. . |

FOREIGN PATENT DOCUMENTS

1143168 * 2/1989 (GB) .

OTHER PUBLICATIONS

"Patented Heat treating System Uses Magnetic Field Technology for Through–Heating of Metal Parts" by D. Keith Patrick, Industrial Heating/Mar. 1998.

* cited by examiner

*Primary Examiner*—Sikyin Ip

(57) ABSTRACT

A process for forming a precision formed cup-shaped member includes stamping a blank into a cup-shaped member. The cup-shaped member is positioned onto a magnetic heating machine. A magnetic core is positioned adjacent a radius of the cup-shaped part on both a top side and a bottom side of the cup-shaped part. The part is heated with the magnetic heating machine so as to anneal the cup-shape part at the radius.

14 Claims, 2 Drawing Sheets

METHOD FOR ANNEALING STAMPED COMPONENTS

FIELD OF THE INVENTION

The present invention relates to a method for annealing stamped components, and more particularly to a method for locally annealing sharp radii in precision formed housings, the housings being formed by a stamping process and made from a carbon or HSLA steel.

DESCRIPTION OF THE PRIOR ART

In an automatic transmission, several components are formed from carbon steel or HSLA steel. Torque transmission members include a number of drums which are stamped and splines are rolled into the cup-shaped outer periphery. Normally, the stamping displaces the grain structure of the steel thereby work hardening the part. This work hardening causes high stresses at the radius and slivering may occur within such drums. Typically, such parts are annealed in a furnace, wherein the entire part is heated to the appropriate temperature and the entire part is annealed, although only the stress areas require such annealing. This process requires a long cycle time to heat the entire part and anneals portions of the part for which it is not desired to be annealed and therefore softened.

The work hardening creates further problems in that the hardened portion creates areas of high stress that may contribute the fatigue and/or failure such as cracking, splintering or slivering of the material. Methods to control these problems include additional die stations to control and minimize the amount of displacement in a particular stamping operation. Alternatively, a steel having a lower carbon content may be used. Or, alternatively, a nonselected stress relief process may be used to anneal the entire component in a furnace or oven. Each of the above may require additional cost or produce undesirable characteristics in the part.

One such component is a hub for a reverse and low gear, one-way clutch in the Ford CD4E automatic transmission. It would therefore be desirable to produce a precision stamped component and anneal the areas of high stress in the stamped component.

SUMMARY OF THE INVENTION

According to the present invention, a stamped component is locally annealed using a magnetic heating process. By doing so, stresses in the part are reduced so as to avoid splintering, slivering, or other defects during subsequent operations.

A process for forming a precision formed cup-shaped member is provided, including stamping a blank into a cup-shaped member. The cup-shaped member is positioned onto a magnetic heating machine. A magnetic core is positioned adjacent a radius of the cup-shaped part on both a top side and a bottom side of the cup-shaped part. The part is heated with the magnetic heating machine so as to anneal the cup-shape part at the radius.

DETAILED DESCRIPTION OF PREFERRED EMBODIMENT(S)

Figure 1:
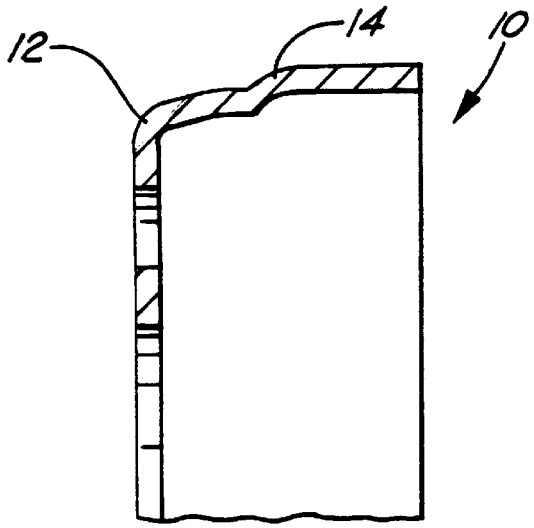
FIG. 1 is a partial sectional side view of a precision stamped component according to the present invention.

As shown in FIG. 1, a precision stamped member 10 in a preferred embodiment has a cup-shaped form. The member 10 is formed from flat blank of sheet metal. The flat blank has a radius 12 formed therein to cause the cup-shaped part 10 to acquire its shape. During the formation of the radius 12, a high stress region results thereat. Further, a second radius 14 is formed in the cup-shaped member 10, also causing a residual stress in the part 10.

Figure 2:
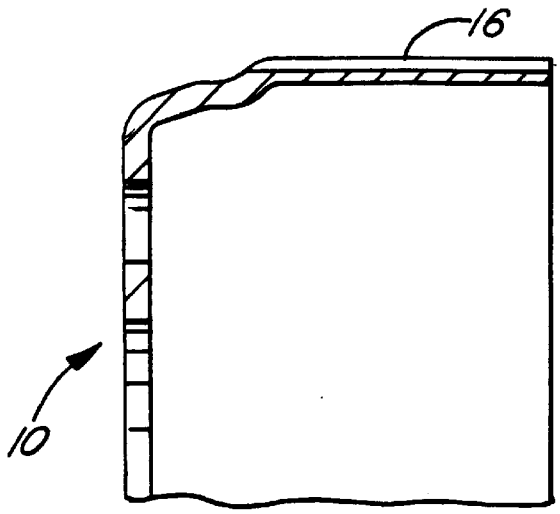
FIG. 2 is a partial sectional side view of the component of FIG. 1 having a further process step formed thereon to form splines in an outer surface thereof.
Figure 2A:
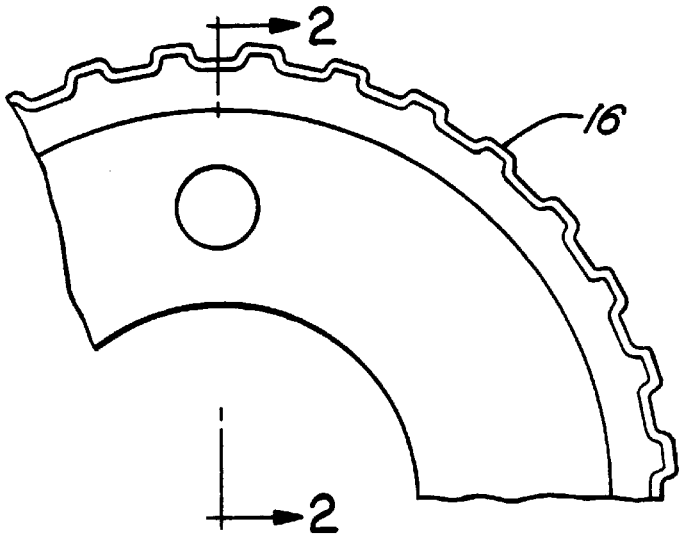
FIG. 2A is a partial end view of the component of FIG. 2.
Figure 3:
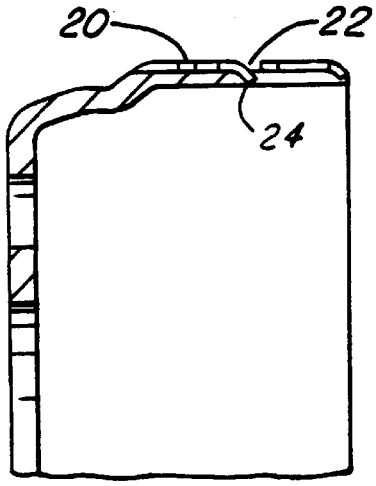
FIG. 3 is a partial sectional side view of the component of FIG. 1 having yet further operations formed thereon.

As shown in FIG. 2, the cup-shaped part 10 has a later process step formed thereon to form a plurality of splines 16, as better illustrated in the view shown in FIG. 2*a*. As shown in FIG. 3, a plurality of apertures 20, 22 are formed in the member. Similarly, a plurality of oil vanes 24 may be formed therein. Each of the subsequent operations illustrated in FIGS. 2–3, if performed on the part 10 in a high stress area (i.e. after forming to the shape shown in FIG. 1 without heat treating), would result in frequent defects in the form of fracturing or slivering in this region of the part.

Figure 4:
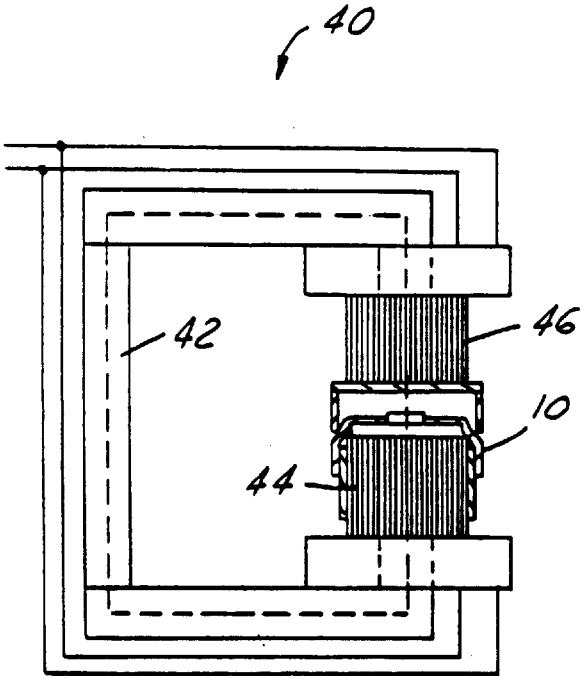
FIG. 4 is a schematic representation of a machine for use with the method according to the present invention.

As shown in FIG. 4, a magnetic heating machine 40 according to the present invention is illustrated schematically. As described in "Patented Heat Treating System Uses Magnetic Fuel Technology for Through-Heating of Metal Parts", by D. Keith Patrick, in *Industrial Heating,* March 1998, pp. 61–68, a magnetic heating process is described, the article incorporated herein by reference. A machine 40 according to this article is further described in U.S. Pat. No. 5,025,124, and *The Principles of Uniform Magnetic Heating* (*UMH*), by Mitsubishi and Core-Flux, both of which are incorporated herein by reference.

As described in the '124 patent, and as illustrated schematically in FIG. 4, a machine 40 includes a C-frame 42 which is used to magnetically heat the parts. The C-frame 42 includes a first, or upper, core 46 positioned adjacent the workpiece 10 opposite a second core 44 positioned the workpiece 10 on the opposite side thereof. The cores 46, 44 are strategically positioned so as to magnetically heat the part 10 at a localized area thereof 12, previously indicated to be a high stress area due to the forming operation formed thereon. By so locally applying this magnetic field, the part 10 may be annealed at this local radius 12, or locally at any other portion, in order to soften the material to prevent damage during further forming operations performed on the part 10 and/or use of the part 10 in a vehicle. In a preferred embodiment, the part 10 is made of a soft steel, such as SAE 1020, and has a hardness of about 85 Rb at the radius 12 after cold forming. The process anneals the part 10 at the radius 12 to a hardness of about 60 Rb, approximately equivalent to the hardness of the remainder of the part 10.

Figure 5:
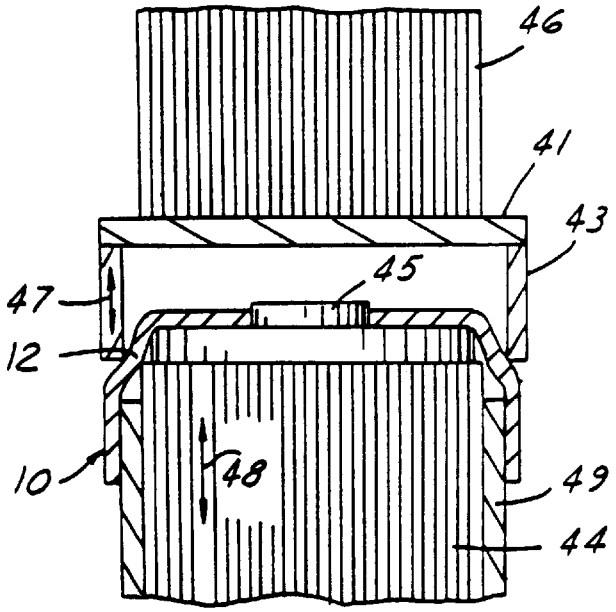
FIG. 5 is a schematic representation of a part in a machine for use with the method according to the present invention.

As shown in FIG. 5, the cores 44, 46 are placed near the radius 12. Thus, the lines of flux 47, 48 which travel through the part 10 are concentrated at the radius 12, thereby heating the part at the radius 12 to approximately a minimum temperature of 400° F. This enables the part 10 to be annealed locally as would be appreciated by one skilled in the art upon reading this disclosure. As described in the Mitsubishi publication, the UMH system operates on the basis of a hysteresis loss system. Preferably, the frequency of the power supply is adjusted to optimize the efficiency of the heating process, so as to heat the part at about the resonance of the part 10. In a preferred embodiment, a part 10 of about 173 MM diameter having a height of about 60 mm and weighing about 0.45 kg. is best heated with a power supply frequency of about 140 Hz. The current flow is adjusted in a similar manner to optimize the process to achieve the desired temperature.

The machine 40 includes a number of details to heat, locate and support the part 10 as described below. The upper and lower cores comprise a laminated material, such as a grain oriented silicon directional steel, known to one skilled in the art. Attached to the upper core 46 is a plate 41. The plate 41 is provided to support a hoop 43. The plate 41 and hoop 43 in a preferred embodiment comprise a low carbon steel material. The hoop 43 is provided to direct the flux 47 at the local area, such as the radius 12, to be heated. The hoop 43 circumferentially surrounds the radius 12 and is provided in light contact therewith.

The lower core 44 includes an insulator 45 provided on a top surface thereof. The insulator 45 provides a horizontal surface to support the part 10 vertically. The insulator 45 may also provide features to locate the part horizontally, such as a vertical projection 45' to protrude through an opening provided on the part 10 and provide an interference fit or small clearance to locate the part 10. A second insulator 49 is provided about the outer portion of the lower core 44. The second insulator is used to insulate the inner circumference of the part 10 from the lower core 44.

Subsequent to the annealing step above, the process steps of forming the splines 16 on the outer surface of the part 10, as indicated in FIG. 2 at 16, is performed using the GROB process as is also known to one skilled in the art. One skilled in the art appreciates the GROB process is one preferred cold working rolling process for cold forming the splines, and alternative methods exist to form these splines. The subsequent operations of forming the holes and oil dams 20, 22, 24, as indicated in FIG. 3, are performed using typically pressing, punching, piercing, and forming operations known to one skilled in the art. The annealing process permits one to locally anneal the part 10 and thereby prevent damage of the part, such as slivering, during the subsequent forming operations.

In a preferred embodiment, the annealing process is performed in a nitrogen atmosphere to eliminate oxidation and scaling during this operation within a chamber. Alternatively, this operation could be performed without the use of a cover gas, but the resultant oxidation would be produced.

Although the preferred embodiments of the present invention have been described, it will be apparent to a person skilled in the art that variations may be made to the process that is described herein without departing from the scope of the invention as defined by the following claims.

What is claimed is:

1. A process for forming a precision formed cup-shaped member, comprising the steps of:

forming a blank;

stamping the blank into a cup-shaped member;

positioning the cup-shaped member on a magnetic heating machine;

positioning a magnetic core adjacent a radius of the cup-shaped part on both a top side and a bottom side of the cup-shaped part; and heating the cup-shaped part with the magnetic heating machine so as to anneal the cup-shape part locally at the radius.

2. The process according to claim 1, further comprising the step of cold forming a plurality of splines about the outer circumference of the cup-shaped member after the part is magnetically heated.

3. A process according to claim 2, further comprising the step of piercing oil holes through one of the splines formed therein.

4. A process according to claim 1, further comprising the step of introducing an oxygen-starved atmosphere prior to heating the part.

5. A process for forming a precision formed cup-shaped member, comprising the steps of:

forming a blank;

forming the blank into a cup-shaped member having a sharp radius;

positioning the cup-shaped member on a magnetic heating machine;

positioning a first magnetic core adjacent an outside portion of the sharp radius of the cup-shaped part;

positioning a second magnetic core adjacent an inside portion of the sharp radius of the cup-shaped part; and applying a magnetic field to heat the cup-shaped part so as to anneal the cup-shape part substantially only at the radius.

6. The process according to claim 5, wherein the magnetic field heats the cup-shaped member using a hysteresis loss principle.

7. The process according to claim 6, further comprising the step of forming a plurality of splines about an outer circumference of the cup-shaped member.

8. The process of claim 7, wherein the splines are formed using a cold forming process.

9. A process according to claim 8, further comprising the step of piercing oil holes through one of the splines formed therein.

10. A process for forming a clutch hub for an automatic transmission, comprising the steps of:

forming a blank;

forming the blank into a cup-shaped hub having a radius;

positioning the hub on a magnetic heating machine;

positioning a first magnetic core adjacent an outside portion of the radius of the hub;

positioning a second magnetic core adjacent an inside portion of the radius of the hub; and applying a magnetic field to heat the hub using a hysteresis loss so as to anneal the hub substantially only at the radius.

11. The process according to claim 10, further comprising the step of forming a plurality of splines about an outer circumference of the hub after the step of applying the magnetic field to the hub.

12. The process of claim 11, wherein the splines are formed using a cold forming process.

13. A process according to claim 12, further comprising the step of piercing oil holes through one of the splines formed in the hub.

14. A process according to claim 10, further comprising the step of introducing a nitrogen atmosphere before magnetically heating the hub.

* * * * *